United States Patent [19]

White, Sr.

[11] 4,153,253

[45] May 8, 1979

[54] ROAD HOCKEY PUCK

[76] Inventor: Thomas P. White, Sr., 159 King St., East, Saint John, New Brunswick, Canada, E2L 1G9

[21] Appl. No.: 868,542

[22] Filed: Jan. 11, 1978

Related U.S. Application Data

[60] Division of Ser. No. 723,642, Sep. 15, 1976, Pat. No. 4,078,801, which is a continuation-in-part of Ser. No. 320,176, Jan. 2, 1973, Pat. No. 3,997,164, which is a continuation of Ser. No. 51,310, Jun. 30, 1970, abandoned.

[51] Int. Cl.[2] ..... A63B 71/00

[52] U.S. Cl. ..... 273/128 R; 40/327

[58] Field of Search ..... 273/128 R, 128 A, 128 CS, 273/106 R, 128 R, 1 B, 128 A, 58 B, 126 R, 128 CS; 272/107

[56] References Cited

U.S. PATENT DOCUMENTS

| | | | |
|---|---|---|---|
| 797,675 | 8/1905 | Fletcher | 273/126 R |
| 2,640,699 | 6/1953 | Garbo | 273/128 R |
| 2,886,320 | 5/1959 | Van Hennik | 273/128 R |
| 3,704,891 | 12/1972 | Chiaralli | 273/128 R |

FOREIGN PATENT DOCUMENTS

| | | | |
|---|---|---|---|
| 347948 | 1/1922 | Fed. Rep. of Germany | 272/107 |
| 361673 | 9/1922 | Fed. Rep. of Germany. | |

*Primary Examiner*—Richard C. Pinkham
*Assistant Examiner*—T. Brown
*Attorney, Agent, or Firm*—Cushman, Darby & Cushman

[57] ABSTRACT

A puck for playing an ice hockey-like game, on untraditional surfaces, is provided with a generally cylindrical body of foam rubber or the like. Two smaller-diameter disks or end plates of glide material are secured coaxially therewith on respective opposite ends of the body. The disks and main body are attached to each other by adhesive bonding; maybe a provision is made within the main body and between the end disks to receive weights. An aperture is provided for installing selected amount of material internally of the body weighting after the disks and main body have been secured together.

7 Claims, 4 Drawing Figures

ROAD HOCKEY PUCK

REFERENCE TO RELATED APPLICATION

This is a division of application Ser. No. 723,642 filed Sept. 15, 1976, now U.S. Pat. No. 4,078,801, issued Mar. 14, 1978, which in turn is a continuation in part of my earlier, copending U.S. Pat. application Ser. No. 320,176, filed Jan. 2, 1973, now U.S. Pat. No. 3,997,164, issued Dec. 14, 1976, which is, in turn, a continuation of Ser. No. 51,310, filed June 30, 1970, and abandoned in favor thereof.

BACKGROUND OF THE INVENTION

The game of road hockey bears a similar relation to ice hockey as soft ball bears to hard ball. The rules are similar, and a similar puck is put in play between, about and in similar goals, by people manipulating similar sticks to those used in normal play of ice hockey. A stick specially designed to be used as a road hockey stick is disclosed in my U.S. Pat. No. 3,377,065, issued Apr. 9, 1968, and another U.S. Pat. No. 3,529,825, issued Sept. 22, 1970.

Because road hockey can be as enjoyable to play for recreation as it can be to play in an essentially competitive spirit, it is enjoyable for a greater number of participants each time an innovation makes it safer to play, provided in enhances or does not reduce the basic similarities between the games. Many who play road hockey also play ice hockey and most at least follow the latter sport. Thus, it is important that a road hockey puck when passed or shot act in flight and in interaction with sticks much like an ice hockey puck does. It is easy to see that a traditional ice hockey puck, if used for road hockey, may make the game too rough to be played by people wearing no more physical protection than street clothes, except those keen enough to avoid or tolerate injury.

Road hockey can be played on convenient hard surfaces like play grounds, parking lots, roads or even on ice.

SUMMARY OF THE INVENTION

In my aforesaid patents, more about the game of road hockey is set forth, as are several designs of road hockey pucks. In view of the availability of copies of those patents, their disclosure is not duplicated here.

In the course of time and with further experience, I have made what I believe to be refinements of these basically good designs of road hockey pucks. They are described herein.

The present invention provides a puck for playing an ice hockey-like game, or untraditional surfaces, which is provided with a generally cylindrical body of foam rubber or the like. Two smaller-diameter disks or end plates of glide material are adhesively secured coaxially therewith on respective opposite ends of the body. In some instances, a provision is made within the main body and between the end disks to receive weights. A way is disclosed for installing a selected amount of internal weighting after the disks and main body have been secured together.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS IN THE DRAWINGS

DETAILED DESCRIPTION OF THE PRESENTLY PREFERRED EMBODIMENT OF THE INVENTION

Figure 1:
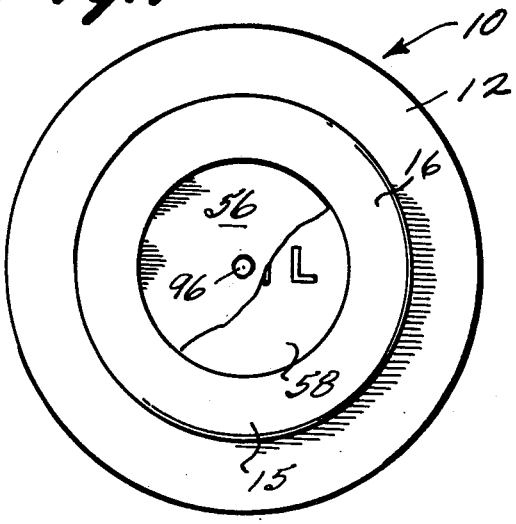
FIG. 1 is a top plan view of a presently preferred embodiment of the road hockey puck of the invention.
Figure 2:
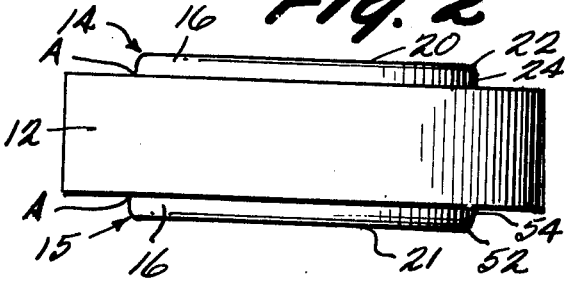
FIG. 2 is a side elevation view of the puck of FIG. 1.
Figure 3:
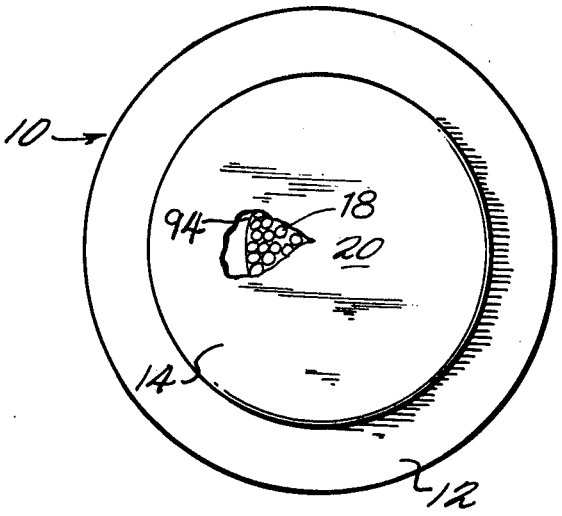
FIG. 3 is a bottom plan view thereof.

Referring to FIGS. 1–4, the road hockey puck 10 is assembled from a main body 12, and two end plate members 14, 15 bearing end disks 16. Internal weighting means 18 is preferably provided within the main body 12, between the end disks 16. The puck 10 should weigh no more than a regular ice hockey puck, 170.1 grams (six ounces). However, it is preferable for the puck 10 to be somewhat less massive, though substantially the same size as a regular ice hockey puck. For instance, the puck 10 (not counting the weight 18) may weigh about 120 grams and the weighting means 18 weigh up to about 15 grams.

Typically, the main body 12 measures 8.572 cm diameter by 2.222 cm thickness and the end disks 16 6.35 cm diameter by 0.476 cm thickness.

The main body 12 is made of material that is substantially less dense than the hard rubber of conventional ice hockey pucks. The ideal material is one (a) durable enough to withstand being shot against the boards placed about the perimeter of the playing surface, and (b) resilient enough to be used in the play of road hockey by players wearing no more rugged protection than blue jeans or the like, yet (c) not so flexible that when the puck hits the boards or a person, the main body compresses enough to let the disks 16 smack against the boards or persons. A material I presently prefer to use to make the main body is a durable and relatively firm foam rubber known as Nuron Crepe which is available in sheets from American Biltrite Inc., Tech. Sq., Cambridge, Mass. and Sherbrooke, Quebec. The main body may be cut from that sheet material.

The end plate members 14, 15 are made of denser material with good axially outwardly presented glide surfaces 20, 21. I presently prefer to injection mold the end plate members 14, 15 of a thermoplastic material such as high density polyethylene that can be which permits the end plate members to be adhered to the main body using an adhesive at A.

The weighting means 18 is preferably lead or steel shot or one or more slugs or sleeves of those or similarly weighty materials.

In the preferred embodiment shown, the end plate member 14 has a circular disk 16 with a flat axially outer glide surface 20, filleted at 22 at the radially outer edge 24 of the disk.

The end plate member 15 has a circular disk 16 with a generally flat axially outer glide surface 21, filleted at 52 at the radially outer edge 54 of the disk. A very shallow, e.g. circular recess 56 may be provided in the surface 21 for receiving a decal, label or the like 58 bearing a logograph of the puck manufacturer, a particular sports team or the like. The recess 56 preferably has the same depth and figure as the label 58 so that when the label 58 is in place, the recess 56 is completely filled.

Where it is desired that the puck 10 be heavier than it would be if made only of foam rubber and high density polyethylene, a body of bodies of weighting material 18 may be put in the cavity 94 before the part 15 is assembled to the subcombination 12, 14 and/or a small filler port 96 may be formed e.g. axially centrally through the disk 16 of the end plate 15. Then, even after the part 15 is secured to the subassembly 12, 14 weighting means 18 in the form of small shot pellets or the like may be dropped into the cavity 94 through the opening 96. When about enough weighting means has been added, the opening may be closed, e.g. by melting it closed with the tip of a hot soldering iron or clothes iron. Or it can be blocked by applying the label thereover and or pouring a settable composition such as rubber cement or melted wax into the cavity filling the remainder thereof.

Figure 4:
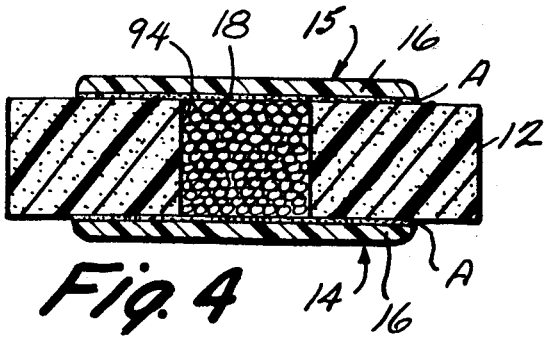
FIG. 4 is a longitudinal cross-sectional view of a variation thereof.

In the variation shown in FIG. 4, each end plate member 14, 15 is constituted by a disk 16. The disks 16 are coaxially secured to the respective end faces of the main body 12 using a suitable adhesive A. In the instance of this variation, the main disk may have its central opening 94 filled with weighting bodies 18 before the second of the disks 26 is secured in place, or the opening may be left empty or omitted.

It should now be apparent that the road hockey puck as described hereinabove, possesses each of the attributes set forth in the specification under the heading "Summary of the Invention" hereinbefore. Because the road hockey puck of the invention can be modified to some extent without departing from the principles of the invention as they have been outlined and explained in this specification, the present invention should be understood as encompassing all such modifications as are within the spirit and scope of the following claims.

In the variation shown in FIG. 9 the opening 198 centrally through the main body 12 when it is molded by the blowing agent method which tends to shrink when curing has a puckered inside diameter wall formed by triangles 182 which extend axially radially from the apexes 190 to the bases 192. In the process of curing the triangles 182 shrink to a smaller size 180 and the bases 192 are withdrawn axially radially by the shrinkage of the main body 12 to a new position 188 and it follows that the apexes are necessarily withdrawn to a new position 186 which is a greater inside diameter than 190 but of lesser inside diameter than the wall 134 of the flange which is thrust into said opening 198 thus when the flange is inserted into the central opening 198 the apexes 184 are compressed sufficiently enough to allow entry of the plastic flange while at the same time now frictionally grasping the wall 134, thus supplying a fit which is neither too loose nor too tight, either condition of which would be detrimental to the functional fit of the main body 12 and the plastic flange wall 134.

In the variation shown in FIG. 10 the pucker is moulded in curved convolutions 282 at a dimension 292 arcing at 290 then shrinking to the dimensioning represented at 288 and 286 then when the flange is inserted the outer diameter of its wall 234 will compress the arcs 286 into a surface 284 which is now frictionally grasping wall 234.

What is claimed is:

1. A puck for playing road hockey, comprising:

a generally cylindrical main body of foam rubber, having two opposite ends with an outer peripheral sidewall extending therebetween;

two disks of plastic material, each being substantially thinner, of lesser diameter and more dense and rigid than the main body;

adhesive means securing each disk facewise coaxially upon a respective end of the main body;

said puck weighing between 110 grams and 170.1 grams so that it has a weight on the order of that of conventional ice hockey pucks, which weigh 6 ounces (170.1 grams).

2. The road hockey puck of claim 1, wherein:

the relation of the resilience of the foam rubber of the main body to the difference of diameter between the disks and the main body be one chosen to ensure that when the puck is slapped directly against a rigid vertical surface, such as a hockey rink board, at a speed typical of an ice hockey slap shot (about 33.64 to as much as about 49.34 meters per second) the portion of the main body which extends radially outwardly from the peripheries of the disks does not collapse so much as to permit the peripheries of the disks to slam against said rigid vertical surface, while said foam rubber being substantially more resilient than the hard rubber which is used for conventional ice hockey pucks.

3. The road hockey puck of claim 2, wherein:

the disks are made of synthetic polymerized plastic material.

4. The road hockey puck of claim 3 wherein:

the disks are made of high density polyethylene.

5. The road hockey puck of claim 2, wherein:

the main body has means defining a central opening therethrough and wherein at least one body of weighting material having a density that is substantially greater than those of the main body and disks is received in the central opening and housed therein between said disks.

6. The road hockey puck of claim 5, wherein:

the weighting material comprises a plurality of metal shot pellets; and one of the disks is provided with a small diameter shot introduction port for allowing said central opening to be loaded with shot after the disks have been adhered to the main body.

7. The road hockey puck of claim 6, wherein:

said one disk has means defining a shallow, flat-bottomed recess in the outer face thereof and the the shot introduction port emerges from said one disk through the flat bottom of said recess; and further including a label secured to said flat bottom covering the shot introduction port and substantially filling the recess.

* * * * *

UNITED STATES PATENT AND TRADEMARK OFFICE

CERTIFICATE OF CORRECTION

PATENT NO. : 4,153,253

DATED : May 8, 1979

INVENTOR(S) : Thomas Paul White, Sr.

It is certified that error appears in the above-identified patent and that said Letters Patent are hereby corrected as shown below:

Column 3, line 35 - column 4, line 2, delete

"In the variation shown in FIG. 9 the opening 198 centrally through the main body 12 when it is molded by the blowing agent method which tends to shrink when curing has a puckered inside diameter wall formed by triangles 182 which extend axially radially from the apexes 190 to the bases 192. In the process of curing the triangles 182 shrink to a smaller size 180 and the bases 192 are withdrawn axially radially by the shrinkage of the main body 12 to a new position 188 and it follows that the apexes are necessarily withdrawn to a new position 186 which is a greater inside diameter than 190 but of lesser inside diameter than the wall 134 of the flange which is thrust into said opening 198 thus when the flange is inserted into the central opening 198 the apexes 184 are compressed sufficiently enough to allow entry of the plastic flange while at the same time now frictionally grasping the wall 134, thus supplying a fit which is neither too loose nor too tight, either condition of which would be detrimental to the functional fit of the main body 12 and the plastic flange wall 134.

UNITED STATES PATENT AND TRADEMARK OFFICE

CERTIFICATE OF CORRECTION

PATENT NO. : 4,153,253

DATED : May 8, 1979

INVENTOR(S) : Thomas Paul White, Sr.

It is certified that error appears in the above-identified patent and that said Letters Patent are hereby corrected as shown below:

In the variation shown in FIG. 10 the pucker is moulded in curved convolutions 282 at a dimension 292 arcing at 290 then shrinking to the dimensioning represented at 288 and 286 then when the flange is inserted the outer diameter of its wall 234 will compress the arcs 286 into a surface 284 which is now frictionally grasping wall 234."

Signed and Sealed this

*Twenty-fifth* Day of *September 1979*

[SEAL]

*Attest:*

*Attesting Officer*

LUTRELLE F. PARKER

*Acting Commissioner of Patents and Trademarks*